US009112273B2

(12) United States Patent
Christie et al.

(10) Patent No.: US 9,112,273 B2
(45) Date of Patent: Aug. 18, 2015

(54) ANTENNA ASSEMBLY

(71) Applicant: Sarantel Limited, Wellingborough (GB)

(72) Inventors: Andrew Robert Christie, Mawsley (GB); Liam Alan Hardy, Hull (GB)

(73) Assignee: Harris Corporation, Melbourne, FL (US)

( * ) Notice: Subject to any disclaimer, the term of this patent is extended or adjusted under 35 U.S.C. 154(b) by 298 days.

(21) Appl. No.: 13/733,756

(22) Filed: Jan. 3, 2013

(65) Prior Publication Data

US 2013/0181881 A1 Jul. 18, 2013

Related U.S. Application Data

(60) Provisional application No. 61/586,941, filed on Jan. 16, 2012.

(30) Foreign Application Priority Data

Jan. 13, 2012 (GB) ..... 1200638.3

(51) Int. Cl.
*H01Q 1/36* (2006.01)
*H01Q 1/40* (2006.01)
(Continued)

(52) U.S. Cl.
CPC ..... *H01Q 1/40* (2013.01); *H01Q 1/362* (2013.01); *H01Q 1/42* (2013.01); *H01Q 11/08* (2013.01); *H01Q 21/30* (2013.01); *H01Q 23/00* (2013.01)

(58) Field of Classification Search
CPC ..... H01Q 1/40; H01Q 11/08; H01Q 23/00; H01Q 1/42; H01Q 21/30; H01Q 1/362
USPC ..... 343/895, 702, 872
See application file for complete search history.

(56) References Cited

U.S. PATENT DOCUMENTS 5,300,940 A 4/1994 Simmons
5,541,616 A 7/1996 Kawahata et al.
(Continued)

FOREIGN PATENT DOCUMENTS

CN 2899134 5/2007
DE 102004040258 2/2006
(Continued)

OTHER PUBLICATIONS

Combined Search and Examination Report dated Apr. 17, 2013, from corresponding GB Patent Application No. 1222323.6, 9 pp.
(Continued)

*Primary Examiner* — Hoanganh Le
(74) *Attorney, Agent, or Firm* — Klarquist Sparkman, LLP

(57) ABSTRACT

Among the embodiments disclosed herein is an antenna assembly comprising the combination of a dielectrically loaded antenna and a housing, the housing incorporating a connector for coupling the antenna to host equipment. The antenna comprises an insulative core which has an outer surface and is shaped to define a central axis, and a laminate board on the central axis, the laminate board extending proximally from a proximal core surface portion oriented transversely with respect to the axis. The housing comprises a housing body which forms a hollow conductive shield for the laminate board, and is centered on the antenna axis, and the housing is shaped to provide a mounting surface which, in a cross-sectional plane perpendicular to the axis, defines a periphery of an area in the said plane which area is at least as great as the cross-sectional area of the said proximal portion of the antenna.

23 Claims, 3 Drawing Sheets

(51) Int. Cl.

| | |
|---|---|
| ***H01Q 11/08*** | (2006.01) |
| ***H01Q 1/42*** | (2006.01) |
| ***H01Q 21/30*** | (2006.01) |
| ***H01Q 23/00*** | (2006.01) |

(56) References Cited

U.S. PATENT DOCUMENTS

| | | | | |
|---|---|---|---|---|
| 8,514,144 | B2 * | 8/2013 | Gray et al. | 343/892 |
| 2003/0048235 | A1 | 3/2003 | Fukae et al. | |
| 2004/0252063 | A1 | 12/2004 | Sadamori et al. | |
| 2005/0200554 | A1 | 9/2005 | Chau | |
| 2006/0022891 | A1 * | 2/2006 | O'Neill et al. | 343/895 |
| 2006/0022892 | A1 | 2/2006 | O'Neill et al. | |
| 2006/0202902 | A1 | 9/2006 | Noro et al. | |
| 2008/0062060 | A1 | 3/2008 | Noro et al. | |
| 2008/0074328 | A1 | 3/2008 | Noro et al. | |
| 2009/0081963 | A1 | 3/2009 | Boren | |
| 2011/0025580 | A1 | 2/2011 | Gray et al. | |
| 2011/0215986 | A1 | 9/2011 | Tongue | |
| 2011/0221650 | A1 | 9/2011 | Christie et al. | |
| 2012/0287016 | A1 * | 11/2012 | Zalinska et al. | 343/895 |
| 2013/0099999 | A1 | 4/2013 | Christie | |
| 2013/0135169 | A1 | 5/2013 | Christie | |

FOREIGN PATENT DOCUMENTS

| | | |
|---|---|---|
| DE | 102011009283 | 7/2012 |
| EP | 1643594 | 4/2006 |
| GB | 2444388 | 6/2008 |
| GB | 2473676 | 3/2011 |
| GB | 2477289 | 8/2011 |
| GB | 2477290 | 8/2011 |
| JP | 04-271188 | 9/1992 |
| JP | 07-202538 | 8/1995 |
| JP | 07-312520 | 11/1995 |
| JP | 10-256818 | 9/1998 |
| JP | 2001-267826 | 9/2001 |
| JP | 2002-217621 | 8/2002 |
| JP | 2010-200050 | 9/2010 |
| KR | 10-2007-0079761 | 8/2007 |
| WO | WO 99/60663 | 11/1999 |
| WO | WO 03/044895 | 5/2003 |
| WO | WO 2008/001169 | 1/2008 |
| WO | WO 2008/032886 | 3/2008 |
| WO | WO 2008/088099 | 7/2008 |
| WO | WO 2008/144240 | 11/2008 |
| WO | WO 2012/100859 | 8/2012 |
| WO | WO 2013/057478 | 4/2013 |

OTHER PUBLICATIONS

International Search Report dated Mar. 28, 2013, from corresponding International Patent Application No. PCT/GB2012/053163, 5 pp.

Written Opinion dated Mar. 28, 2013, from corresponding International Patent Application No. PCT/GB2012/053163, 7 pp.

Search Report dated May 11, 2012, from corresponding GB Patent Application No. 1200638.3, 2 pp.

Examination Report dated Mar. 6, 2014, from corresponding GB Patent Application No. GB1222323.6, 4 pp.

* cited by examiner

ANTENNA ASSEMBLY

CROSS-REFERENCE TO RELATED APPLICATIONS

This application claims the benefit of U.S. Provisional Application No. 61/586,941, filed on Jan. 16, 2012, and entitled "AN ANTENNA ASSEMBLY", and also claims priority to United Kingdom Patent Application 1200638.3, filed on Jan. 13, 2012, and entitled "AN ANTENNA ASSEMBLY", both of which are hereby incorporated herein by reference.

FIELD

This application relates to an antenna assembly for operation at a frequency in excess of 200 MHz, the assembly including a dielectrically loaded antenna and a connector for coupling the antenna to host equipment.

BACKGROUND

One known antenna assembly is disclosed in British Published Patent Application No. GB2473676A and corresponding U.S. application Ser. No. 12/887,220 filed 21 Sep. 2010, the disclosures of which are hereby incorporated by reference. In this known assembly, a dielectrically loaded helical antenna with a solid insulative dielectric core has a coaxial feeder which passes through a passage in the core on a central axis of the antenna. Plated on an outer cylindrical surface of the core are four helical antenna elements and a balun sleeve. An end surface of the core adjacent the balun sleeve is also plated and serves to connect the balun sleeve to the outer conductor of the feeder at the base of the antenna. The connector comprises a central pin soldered to the inner conductor of the feeder, and a hollow outer connection member which encircles the pin and is soldered to the plated end surface of the core so that both the pin and the outer connection member project from the base of the antenna. An insulative moulded covering encases both the antenna and the connector.

In Published International Application No. WO2011/092498, there is disclosed a backfire dielectrically loaded quadrifilar helical antenna in which the feeder is in the form of an elongate laminate board housed in the passage of the core.

It is known to provide a backfire dielectrically loaded helical antenna with an integrated low-noise amplifier. In one example, the antenna is mounted on an end surface of a rectangular plated enclosure, the amplifier comprising a printed circuit board housed in the enclosure and coupled, at one edge, to a coaxial feeder projecting from the base of the antenna and, at an opposite edge, to a coaxial connector mounted on the opposite end of the enclosure. The enclosure has a removable conductive lid. Such an assembly is disclosed in a flysheet issued by Sarantel Limited in May 2003 and entitled "GeoHelix-HTM GPS Antenna".

SUMMARY

Certain embodiments of the disclosed technology provide an improved and more versatile rugged antenna assembly.

In some embodiments of the disclosed technology, an antenna assembly for operation at a frequency in excess of 200 MHz comprises the combination of a dielectrically loaded antenna and a housing, the housing incorporating a connector for coupling the antenna to host equipment, wherein: the antenna comprises an insulative core which has an outer surface and is shaped to define a central antenna axis, at least one conductive element on or adjacent the core outer surface, and a laminate board on the central axis, the outer surface of the core including proximal and distal surface portions oriented transversely with respect to the axis and a side surface portion surrounding the axis and extending between the proximal and distal surface portions, and the laminate board extending proximally from the proximal core surface portion; the housing comprises a housing body which forms a hollow conductive shield for the laminate board, and is centred on the antenna axis, the housing body having a distal recess which is bounded by a distal housing rim and is shaped and dimensioned to house a proximal portion of the antenna with the distal rim surrounding and engaging the antenna side surface portion, a side wall which extends proximally from the housing rim to surround the axis thereby to enclose an interior space containing the laminate board, and a proximal connector portion housing a signal contact insulated from the conductive shield and connected to a signal conductor of the laminate board; and the housing is shaped to provide a mounting surface which, in a cross-sectional plane perpendicular to the axis, defines a periphery of an area in the said plane which area is at least as great as the cross-sectional area of the said proximal portion of the antenna. In one embodiment of the antenna assembly, the antenna has a solid core and the core outer surface defines an antenna volume the major part of which is occupied by the solid dielectric material of the core. In this example assembly, the antenna core has multiple helical antenna elements plated on the cylindrical surface. The material of the core may be a ceramic and it preferably has a relative dielectric constant of at least 5. The core has an axial passage extending from the core distal surface portion to the proximal surface portion. In this embodiment, the core has a constant cross-section and is cylindrical, although other cross-sections are possible. It is preferred that the laminate board constitutes an elongate feeder structure extending through the passage from a feed connection at the core distal surface portion to the above-mentioned connection with the signal contact of the housing connector. Lying face-to-face on the distal surface portion of the core is a small disc-shaped lateral laminate board part which serves to connect the feeder structure to the helical antenna elements. The laminate board, in this case, comprises an elongate transmission line section in the core passage and a proximal portion, the board lying in a plane containing the central axis. Where the board projects from the proximal end surface portion of the core, its lateral extent is greater than that of the transmission line section. The laminate board part coupling the feeder structure to the antenna elements is perpendicular to the axis and to the plane of the elongate laminate board.

The housing typically includes an insulative cover, preferably a moulded thermoplastics cover, which surrounds and encapsulates the antenna and the housing body. The above-mentioned mounting surface of the housing may be on the cover or it may be on the housing body. In either case, the surface is preferably annular and centred on the antenna axis. The mounting surface may be a proximally facing surface to engage and seal against a mating surface on an equipment housing, for instance; or it may be a surface which faces radially outwardly to engage, e.g., the sides of a recess in the equipment housing. In the latter case, the mounting surface may be threaded. The mounting surface is preferably a proximal mounting surface in that it is located on a proximal part of the housing.

In the case of the mounting surface being on the insulative cover, it may be formed as a proximally facing surface on an internal lip of the cover, the housing body having a proximally facing bearing surface which bears against a distal surface of the internal lip so that when, for instance, the housing body is screwed onto a threaded boss on an equipment housing, the cover lip is compressed between the housing body bearing surface and an annular mounting surface on the equipment housing.

In general, it is preferred that the housing body has an annular threaded portion for securing the assembly to the host equipment, the threaded portion being centred on the antenna axis.

In the preferred embodiment, the housing has a generally cylindrical outer surface centered on the antenna axis and extending from the housing rim to the proximal connector portion, this mounting surface being annular and the periphery being generally circular. The mounting surface is typically a proximally directed surface surrounding the connector.

The connector preferably comprises the coaxial combination of a sleeve contact electrically connected to the material forming the conductive shield formed by the housing body and an axial pin forming the signal contact. Advantageously, both contacts project proximally with respect to the proximally directed mounting surface.

Internally, the housing of the preferred embodiment has a groove locating a proximal edge of the laminate board and, similarly, the antenna core has recesses in its proximal surface portion which receive and locate radially extending distally directed edges of the laminate board.

The interior space of the housing may be sufficiently large to accommodate a laminate board having filter or amplifier circuitry coupling the antenna element or elements to the connector signal contact.

To aid structural strength, the antenna core may be bonded to the housing body in the distal recess of the latter. In the case where the housing body constitutes a solid metallic component of the assembly and the antenna has a proximal portion with a metallised coating, such as the above-described balun sleeve, the core is bonded to the housing by soldering or using a conductive glue such as a silver-loaded epoxy resin. Alternatively, the housing body may be a conductively plated plastics component of the assembly. Again, the housing body may then be conductively bonded to a conductive layer on the core. It is preferred that the housing body is a single integral component.

Certain embodiments of the disclosed technology comprise an assembly in which the antenna comprises a cylindrical backfire helical antenna having a plurality of helical elements plated on the side surface portion of the core and extending from a connection to an axial shielded feeder at the core distal surface portion to a conductive balun sleeve plated on a proximal part of the core side surface portion, the sleeve being conductively bonded to the housing body around an annular interface between the antenna core and the housing body adjacent the distal housing rim. For protection, a moulded insulative cover is provided, enclosing the antenna and the side of the housing, the housing having at least one keying feature to resist removal of the cover in the axial direction and rotation of the cover on the combination of the antenna and the housing.

Embodiments of the disclosed technology combine robustness, ease of connection to host equipment and production economy.

BRIEF DESCRIPTION OF THE DRAWINGS

The disclosed technology will now be described by way of example with reference to the drawings in which.

DETAILED DESCRIPTION

Figure 1:
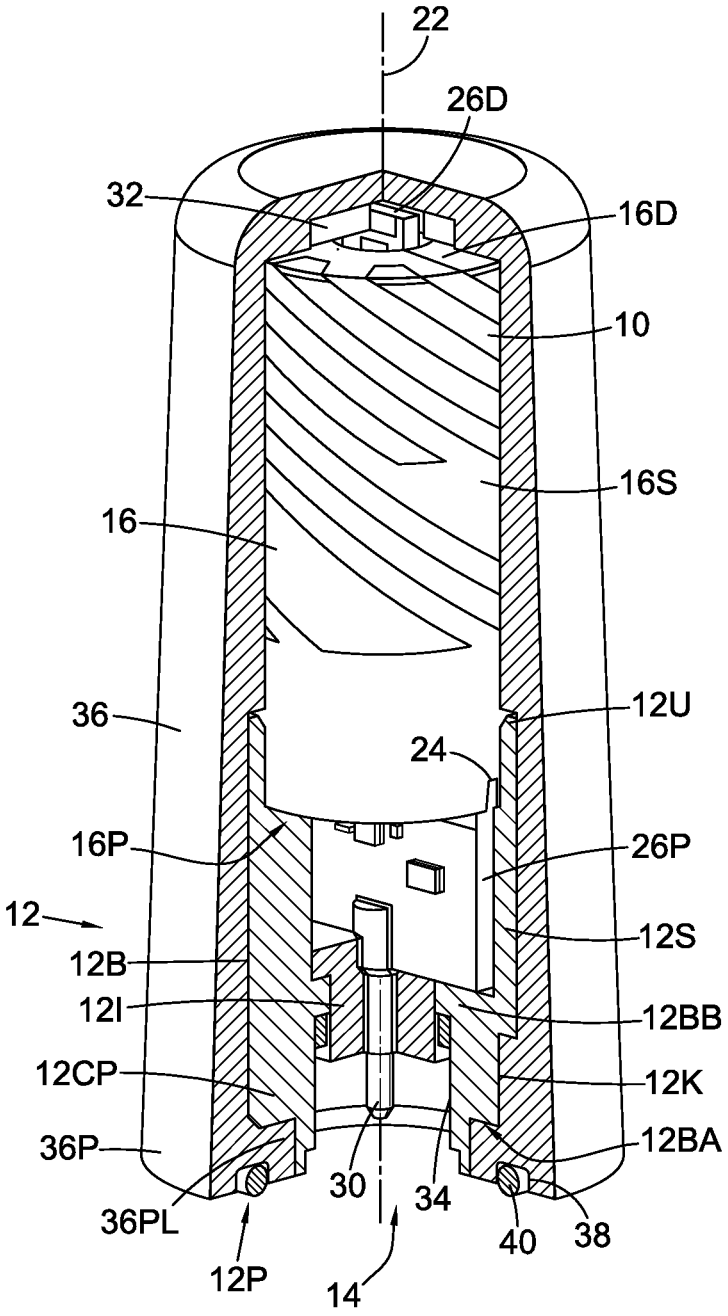
FIG. 1 is a cut-away perspective view of an antenna assembly in accordance with an embodiment of the disclosed technology, including a protective cover.
Figure 2:
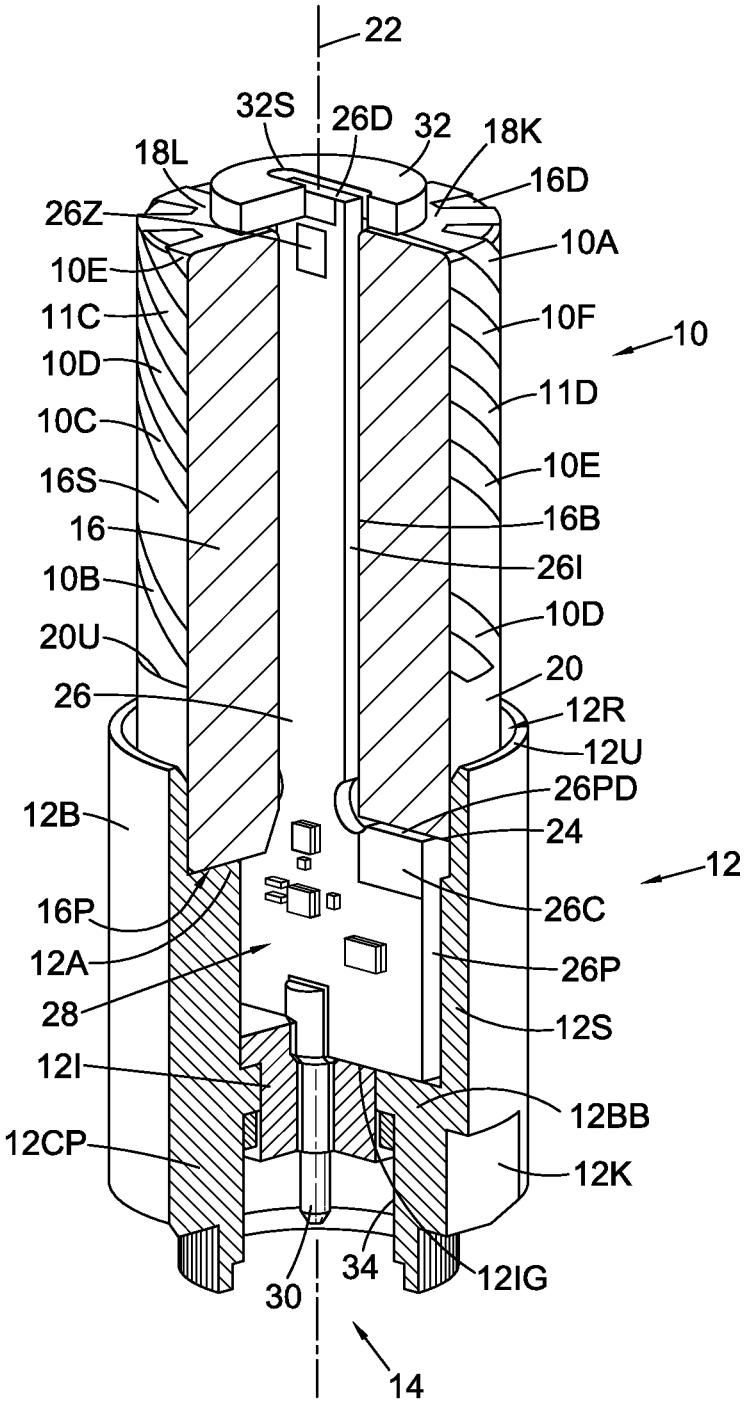
FIG. 2 is a cut-away perspective view of the antenna assembly of FIG. 1, with the cover removed.
Figure 3:
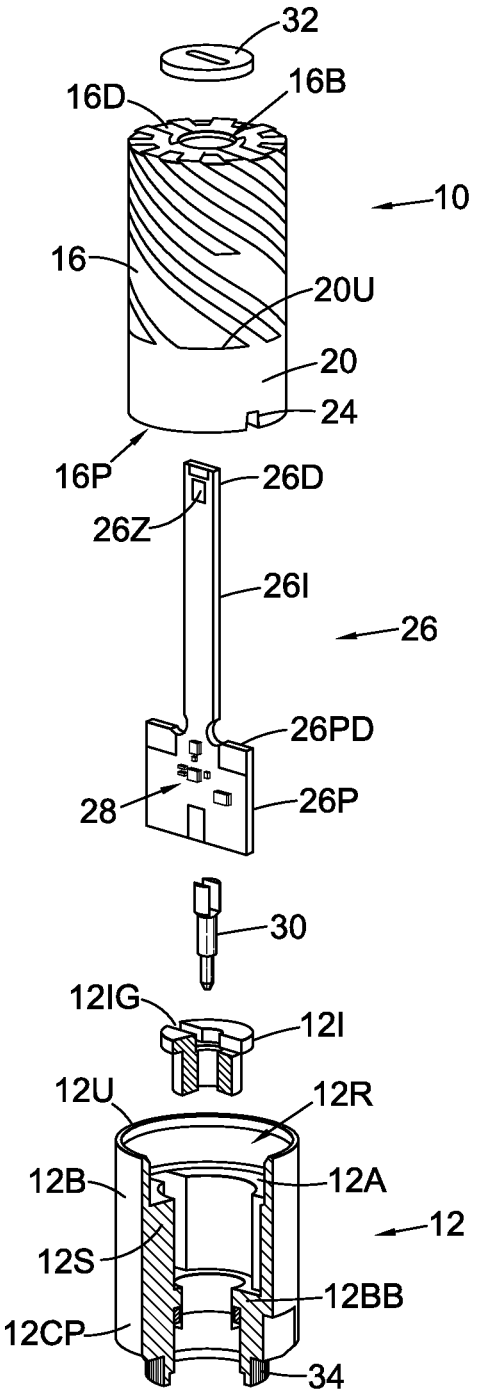
FIG. 3 is an exploded view of the antenna assembly of FIGS. 1 and 2.

Referring to FIGS. 1 to 3, an antenna assembly in accordance with embodiments of the disclosed technology has a dual-band dielectrically loaded antenna 10 for operation at two frequencies in excess of 200 MHz, in this case the GPS L1 and L2 frequencies, 1575 MHz and 1228 MHz. The antenna 10 is received in a housing 12 incorporating a connector 14 for coupling the antenna to host equipment. In this embodiment of the disclosed technology, the antenna is a dual-band multifilar antenna having, as shown in FIG. 2, two groups of helical conductive antenna elements 10A-10F; 11A-11D (not all of which are visible in FIG. 2) plated on a cylindrical side surface portion 16S of a cylindrical dielectric core 16, as disclosed in WO2010/103264, the disclosure of which is incorporated in the present application by reference. The antenna elements 10A-10F of the first group comprise closed-circuit helical conductive tracks insofar as they extend, via radial connection tracks on a distal end surface portion 16D of the core, from feed connection nodes 18K, 18L on the distal end surface portion 16D to the rim 20U of a conductive sleeve 20 plated on a proximal end part of the core side surface portion 16S. The antenna elements of the second group 11A-11D are open-circuit insofar as they extend from the feed connection nodes 18K, 18L to open-circuit ends spaced from the rim 20U of the sleeve 20.

With regard to the core 16, this is made of a ceramic material, and in this embodiment is a calcium-magnesium-titanate material having a relative dielectric constant in the region of 21. The core is solid with the exception of a bore 16B centred on the central axis 22 of the antenna so that the solid material of the core occupies the major part of the interior volume defined by the core outer surface.

The core distal surface portion 16D is perpendicular to the axis 22. The core 16 has an oppositely directed proximal surface portion 16P which is also perpendicular to the axis, and the bore 16B passes through the core from the distal surface portion 16D to the proximal surface portion 16P. On a diameter and extending on opposite sides of the bore 16B, the distal surface portion 16D has a pair of grooves 24 centred on a diameter. Both the distal surface portion 16D and the grooves 24 are plated, the plated conductive layer being electrically continuous with the sleeve 20. Housed in the axial bore 16B is a laminate board 26 forming part of a feeder structure of the antenna. A distal feed connection portion 26D of the board projects from the distal surface portion 16D of the core by a short distance. Connected to the distal connection portion 26D, the laminate board 26 has an elongate intermediate portion 26I which forms a transmission line section of the feeder structure. At the proximal end of the intermediate portion 16I, at the base or floors of the proximal core grooves 24, the board 26 has a proximal end portion 26P which is wider than the intermediate portion 26I on both sides of the latter and which projects beyond the proximal end surface portion 16P of the core 16. In this embodiment of the disclosed technology, the proximal end portion 26P of the board 26 carries a front-end RF amplifier 28 with an input connected to the transmission line section of the board intermediate portion 26I and an output connected to a forked contact pin 30 located on the axis 22. Being wider than the intermediate portion 26I, the proximal end portion 26P of the board has distally facing edges 26PD which are seated in the grooves 24 in the core to define both the axial position of the board 26 and its rotational position with respect to the antenna elements 10A-10F; 11A-11D and associated conductors plated on the core distal end surface portion 16D, as disclosed in co-pending British Application No. 1120466.6 and U.S. application Ser. No. 61/564,227, filed 25 Nov. 2011 and 28 Nov. 2011 respectively, the contents of which are incorporated herein by reference. The board 26 has three conductive layers which, in the intermediate section 16I, form a quasi-coaxial shielded transmission line, the shield of which is connected on the board to conductor areas 26C (FIG. 2) adjacent the distally facing edges 26PD located in the grooves 24 where, through solder connections, they are connected in the base of each groove 24 to the conductive layer on the proximal end portion of the core. Accordingly, the sleeve 20 of the antenna is connected to the shield of the transmission line formed by the board intermediate section 16I with a minimum path length between the sleeve rim 20U and the shield defined, inter alia, by the axial position of the bases of the grooves 24, thereby defining a sleeve balun. In other variants of the disclosed technology the grooves 24 may be omitted.

Secured face-to-face on the distal surface portion 16D of the core 16 is a disc-shaped lateral laminate board part 32 with a central slot 32S which receives the projecting distal end portion 26D of the laminate board 26 on the axis 22, as shown in FIG. 2. Electrical connections between the conductive layers of the laminate board 26 and those of the lateral laminate board part 32, and between the latter and the feed connection nodes 18K, 18L on the core distal surface portion 26D couple the transmission line of the laminate board intermediate portion 26I to the antenna elements via an impedance matching network 26Z, as disclosed in the above-referenced British Application No. 1120466.6. In this case, the matching network is operable to match the antenna elements 10A-10F, 11A-11D to the transmission line at both operating frequencies.

The antenna 10, comprising the plated core, the axially oriented laminate board 26 and the lateral laminate board part 32, is secured in a receptacle formed as a recess 12R of the housing 12, as shown in FIGS. 1 and 2. The housing 12 comprises a solid metallic housing body 12B which is a single, integrally formed monolithic component. The housing body 12B has a side wall 12S with an outer cylindrical surface, the diameter of which is greater than that of the antenna core 16, the side wall 12S having a distal rim 12U which, in combination with an internal shoulder 12A, defines the recess 12R. In this embodiment of the disclosed technology, the rim 12U of the housing body 12 is continuous. As an alternative the rim may, instead, comprise a plurality of castellations the purpose of which is to locate the antenna 10 on the housing body 12B. Below the shoulder 12A, the thickness of the housing body side wall 12S is such that the housing body defines an interior space which contains the proximal portion 26P of the laminate board 26. This space is closed proximally by a proximal base wall 12BB of a proximal connector portion 12CP of the housing body which has a central hole for the contact pin 30 of the connector 14. In this embodiment of the disclosed technology, the contact pin 30 is seated in a plastics insulator 12I which forms a plug for the central hole in the base wall 12BB, the insulator 12I having a central boss surrounding the pin 30 in the hole and having a larger diameter flange portion which overlies an inner surface of the base wall 12BB.

The contact pin 30 is forked, having a distal slot to receive the proximal edge of the laminate board 26, so that both the pin 30 and the board 26 can lie on the axis 22. The pin 30 is secured to the latter by a solder connection to conductive layers on opposing major faces of the laminate board proximal portion 26P. A diametrical recess in the form of a groove 12IG (FIGS. 2 and 3) in the insulator 12I supports the proximal edge of the laminate board 26.

Centred on the axis and projecting from the base wall 12BB of the proximal connector portion 12CP of the housing body is an internally threaded conductive connector sleeve 34 which, being part of the conductive housing body 12B, forms a sleeve contact. This sleeve contact and the axial pin 30 constitute an SMA connector in this embodiment of the disclosed technology. Alternative standard connector formats may be used in other embodiments.

The housing body 12B is secured to the antenna 10 by a solder connection in the recess 12R, i.e. between the inner surface of the housing body rim 12U and the plated surfaces on the proximal portion of the antenna core 16, particularly the sleeve 20 and the plated proximal surface 16P. As best seen in FIG. 3, the assembly of the antenna 10, the housing 12 and the axial contact pin 30 comprises the preliminary step of assembling the antenna components and fitting the contact pin 30 to the laminate board proximal portion 26P, followed by the insertion of the insulator 12I into the interior space of the housing body 12B, then the insertion of the antenna 10 with contact pin 30 into the housing body 12P so that the pin 30 projects proximally from the centre of the insulator 12I in registry with the sleeve contact 34 of the connector 14. Lastly, the solder joint or alternative conductive bond is formed between the material of the housing body 12B in the recess 12R and the plated proximal portion of the antenna 10.

The antenna housing includes a moulded protected thermoplastic cover 36 (see FIG. 1). This cover is moulded in situ over the antenna 10 and the housing body 12B so as to match the profile of and encapsulating both. In this embodiment of the disclosed technology, the cover 36 has a proximal end portion 36P which surrounds the proximal connector portion 12CP of the housing body 12B, this proximal cover portion 36P terminating in a mounting surface 12P which is located to engage a mating surface on the host equipment. The mounting surface 12P is annular and proximally directed, being centred on the axis 22 so as to encircle the sleeve contact 34 of the coaxial connector 14. The cover proximal portion 36P has an internal annular lip 36PL engaging a proximally facing annular bearing surface 12BA on the housing body 12B which bears against a distal surface of the internal lip 36PL. The proximal mounting surface 12P is formed on the internal lip 36PL. Accordingly, when the assembly is fitted to the host equipment by screwing the connector 14 onto a mating connector part on the host equipment, the housing body distal surface 12BA bears against the internal lip 36PL of the cover 36 so as to urge the proximal mounting surface 12P against the host equipment.

Since the proximal mounting surface 12P has a circular periphery enclosing an area in a plane perpendicular to the axis 22 which is greater than the cross-sectional area of the antenna core, the abutment surface of the proximal mounting surface 12P in this preferred embodiment of the disclosed technology has a diameter at least as great as that of the antenna core 16. This means that the antenna assembly as a whole can be rigidly and robustly mounted to a suitable mating surface on the host equipment. Mounting of the assembly does not rely on the resistance of the coaxial connector 14 alone to moments about axes perpendicular to the assembly axis 22 produced by forces acting laterally on the sides of the assembly caused, for instance, by lateral blows or lateral pressure. Despite the length added to the antenna 10 by the shielded proximal laminate board portion 26P and the resulting longer lever arm produced by the structure, compared with one in which the antenna is configured to be mounted directly on a host surface the presence of the annular proximal mounting surface 12P relieves the potentially damaging strain on the contacts 30, 34 of the connector 14. It will be noted that the housing body 12B has flats 12K (one of which is shown in FIG. 2 on its outer surface) forming recesses as key features shaped to retain the cover 36 on the housing not only in the axial direction, but also to prevent rotation of the cover 36 relative to the housing body 12B about the axis 22.

Cut into the proximal mounting surface 12P is an annular groove 38 which may be used to house a resilient O-ring 40 as part of the mounting surface 12P for improved sealing against the mating surface of the host equipment.

In the above-described embodiment, as shown in FIG. 1, the cover 36 is moulded in-situ over the combination of the housing body 12B and the antenna 10. As an alternative, the cover 36 may be separately moulded and then snapped over the antenna and the housing body.

The antenna assembly described above and shown in the drawings is configured to be fitted to an SMA connector which stands proud of the mating surface on the host equipment. For this reason, the connector 14 is recessed within the proximal portion 36P of the cover 36. In an alternative embodiment, the connector 14 projects proximally with respect to the proximal edge of the cover 14 to engage a connector which is wholly or partially recessed with respect to the host equipment mating surface. Indeed, the proximal mounting surface 12P may be formed on the housing body 12B rather than on the cover 36, providing the periphery defined by the mounting surface 12P encloses an area greater than the cross-sectional area of the antenna core 16 in order to retain the mounting rigidity referred to above. In this case, too, the abutment of the mounting surface 12P against the mating surface on host equipment is as a result of screwing the assembly onto a threaded portion of the host equipment, the mounting surface being urged into sealing contact with the host equipment mating surface. The connector 14 of the described and illustrated embodiment has an internal thread. It is possible for a securing thread to be provided, instead, on an outer surface of the housing body 12B. Indeed, the threaded surface may, itself, form the proximal mounting surface so as to provide the required rigidity. Other fixing means may be provided, i.e. other than a threaded connection centred on the assembly axis.

The preferred embodiment described above and shown in the drawings incorporates a dual-band antenna having ten helical antenna elements 10A-10F, 11A-11D. Other antenna arrangements are possible, including, for instance, quadrifilar or octafilar antennas. A quadrifilar antenna which may form the basis of such an assembly is disclosed in the above-mentioned WO2011/092498. In that case, the antenna is intended to operate at a single frequency, or within a single band of frequencies, and the matching network is configured accordingly.

Having illustrated and described the principles of the disclosed technology, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only preferred examples of the technologies and should not be taken as limiting the scope of the invention. Rather, the scope of the invention is defined by the following claims and their equivalents. We therefore claim all that comes within the scope and spirit of these claims and their equivalents.

What is claimed is:

1. An antenna assembly for operation at a frequency in excess of 200MHz, comprising the combination of a dielectrically loaded antenna and a housing, the housing incorporating a connector for coupling the antenna to host equipment, wherein:

the antenna comprises an insulative core which has an outer surface and is shaped to define a central antenna axis, at least one conductive element on or adjacent the core outer surface, and a laminate board on the central axis, the outer surface of the core including proximal and distal surface portions oriented transversely with respect to the axis and a side surface portion surrounding the axis and extending between the proximal and distal surface portions, and the laminate board extending proximally from the proximal core surface portion;

the housing comprises a housing body which forms a hollow conductive shield for the laminate board, and is centred on the antenna axis, the housing body having a distal recess which is bounded by a distal housing rim and is shaped and dimensioned to house a proximal portion of the antenna with the distal rim surrounding and engaging the side surface portion, a side wall which extends proximally from the housing rim to surround the axis thereby to enclose an interior space containing the laminate board, and a proximal connector portion housing a signal contact insulated from the conductive shield and connected to a signal conductor of the laminate board;

and the housing is shaped to provide a mounting surface which, in a cross-sectional plane perpendicular to the axis, defines a periphery of an area in the said plane which area is at least as great as the cross-sectional area of the said proximal portion of the antenna, the mounting surface being located proximally on the housing, and wherein the housing includes an insulative cover which surrounds the antenna and the housing body so as to substantially match the profile of and encapsulate both the antenna and the housing body.

2. An assembly according to claim 1, wherein the mounting surface is on the cover.

3. An assembly according to claim 1, wherein the mounting surface is on the housing body.

4. An assembly according to claim 1, wherein the mounting surface is annular and centred on the antenna axis.

5. An assembly according to claim 1, wherein the mounting surface is a proximally facing surface.

6. An assembly according to claim 2, wherein the mounting surface is a proximally facing surface on an integral lip of the cover, the housing body having a proximally facing bearing surface which bears against a distal surface of the internal lip.

7. An assembly according to claim 1, wherein the housing body has an annular threaded portion for securing the assembly to host equipment, the threaded portion being centred on the antenna axis.

8. An assembly according to claim 1, wherein the housing has a generally cylindrical outer surface centred on the antenna axis and extending from the rim to the proximal connector portion.

9. An assembly according to claim 1, wherein the mounting surface is annular and has a generally circular periphery.

10. An assembly according to claim 1, wherein the connector comprises the coaxial combination of a sleeve contact electrically connected to the material forming the said conductive shield and an axial pin forming the signal contact, both contacts projecting proximally with respect to the housing body.

11. An assembly according to claim 10, wherein the mounting surface is an annular, proximally directed surface and the connector contacts project proximally from the mounting surface.

12. An assembly according to claim 1, wherein the body of the housing includes a groove locating an edge of the laminate board.

13. An assembly according to claim 1, wherein the laminate board has a radially extending distally directed edge and the core has a recess in its proximal surface portion which receives and locates the said distally directed edge of the laminate board.

14. An assembly according to claim 1, wherein the antenna core has an axial passage extending therethrough and the laminate board constitutes an elongate feeder structure extending through the passage from a feed connection at the core distal surface portion to the connection with the signal contact of the housing connector.

15. An assembly according to claim 14, wherein the laminate board comprises an elongate transmission line section in the core passage and a proximal portion in the housing interior space, the lateral extent of the proximal portion being greater than that of the transmission line section.

16. An assembly according to claim 1, wherein, in the interior space of the housing, the laminate board has filter or amplifier circuitry coupling the said antenna element to the connector signal contact.

17. An assembly according to claim 1, wherein the antenna core is bonded to the housing body in the distal recess thereof.

18. An assembly according to claim 1, wherein the housing body is a solid metallic component of the assembly or a conductively plated plastics component of the assembly.

19. An assembly according to claim 18, wherein the housing body is an integral one-piece component.

20. An assembly according to claim 18, wherein the antenna proximal portion has a metallised coating which is conductively bonded to the housing body in the recess.

21. An assembly according to claim 20, wherein the antenna comprises a cylindrical backfire helical antenna having a plurality of helical antenna elements plated on the side surface portion of the core and extending from a connection to an axial shielded feeder at the core distal surface portion to a conductive balun sleeve plated on a proximal part of the core side surface portion, the sleeve being conductively bonded to the housing body around an annular interface between the antenna core and the housing body adjacent the said distal housing rim.

22. An assembly according to claim 1, wherein the insulative cover is a moulded cover which encloses the antenna and is keyed to the side wall of the housing.

23. An assembly according to claim 1, wherein the antenna core and the housing body have shape features which locate the housing body rotationally about the axis relative to the antenna core.

* * * * *